US008844844B2

(12) United States Patent
Hsieh

(10) Patent No.: US 8,844,844 B2
(45) **Date of Patent: *Sep. 30, 2014**

(54) MISTING NOZZLE

(75) Inventor: Pai-Chou Hsieh, Chang-Hua County (TW)

(73) Assignee: Yuan Pin Industrial Co., Ltd., Chang-Hua County (TW)

( * ) Notice: Subject to any disclaimer, the term of this patent is extended or adjusted under 35 U.S.C. 154(b) by 344 days.

This patent is subject to a terminal disclaimer.

(21) Appl. No.: 13/332,320

(22) Filed: Dec. 20, 2011

(65) Prior Publication Data

US 2013/0153688 A1 Jun. 20, 2013

(51) Int. Cl.
*B05B 1/34* (2006.01)

(52) U.S. Cl.
USPC ..... 239/470; 239/469; 239/468; 239/488; 239/489

(58) Field of Classification Search
CPC .. B05B 1/3405; B05B 1/3415; B05B 1/3442; B05B 1/3447; B05B 1/3431
USPC ..... 239/463, 468, 491, 488, 489, 383, 469, 239/470
See application file for complete search history.

(56) References Cited

U.S. PATENT DOCUMENTS 5,857,626 A * 1/1999 Hsu ..... 239/381
6,000,636 A * 12/1999 Huang ..... 239/381
6,827,295 B1 * 12/2004 Hendren et al. ..... 239/381

* cited by examiner

*Primary Examiner* — Dinh Q Nguyen

(57) ABSTRACT

A misting nozzle includes a body having a hole centrally defined therein and a flange radially extending therefrom to divide the body into a connecting section and a mounting section. At least two ditches are longitudinally and equally defined in the mounting section, and each laterally communicates with the hole. A distal end of the smooth portion is formed with an abutment and a round recess centrally defined in the abutment. At least two grooves are respectively equally defined in the abutment, wherein each groove is defined along a corresponding one of the tangents of the round recess and has two opposite ends respectively communicating with the round recess and a corresponding one of the ditches. A cap is airtightly mounted onto the mounting section of the body. A funnel-shaped hole is defined in a bottom of the cavity and communicates with the recess.

6 Claims, 9 Drawing Sheets

MISTING NOZZLE

BACKGROUND OF THE INVENTION

1. Field of the Invention

The present invention relates to a misting nozzle, and more particularly to a misting nozzle that can effectively mist water.

2. Description of Related Art

A conventional misting nozzle in accordance with the prior art shown in FIGS. 6-8 comprises a body (10) having a through hole (12) centrally defined therein and a cavity (11) in one end thereof and communicating with the through hole (12). A rotor (20) is rotatably and movably received in the through hole (12). The rotor (20) has an inclined face formed on a first thereof and at least two inclined guide grooves (21) defined in a second end of the rotor (20), wherein the two guide grooves (21) correspond to the cavity (11). A cap (30) is tightly inserted into the cavity (11) to prevent the rotor (20) from detaching from the body (10). The cap (30) has a recess (33) centrally defined therein for rotatably receiving the second end of the rotor (20) when being operated. A tapered hole (32) is centrally defined in a bottom of the recess (33) and a spray hole (31) is centrally defined in the cap (30) and communicates with the tapered hole (32).

When misting water, the rotor (20) is rotated in a high speed when high-pressure water flows into the body (10) and passed through the inclined face (22). As a result, the high-pressure water is misted and sprayed from the spray hole (31) after passing through the two guide grooves (21).

However, the rotor (20) is moved in the through hole (12) due to a pressure of the water that flows through the body (10) such that the gap between the top of the rotor (20) and the cap (30) is changeable. As a result, the water may not be misted when the pressure has been lowed and the gap between the top of the rotor (20) and the cap (30) has been enlarged.

The present invention has arisen to mitigate and/or obviate the disadvantages of the conventional misting nozzle.

SUMMARY OF THE INVENTION

The main objective of the present invention is to provide an improved misting nozzle that can effectively mist water when the water pressure is low.

To achieve the objective, the misting nozzle in accordance with the present invention comprises a body having a hole centrally and longitudinally defined therein and a flange radially extending therefrom to divide the body into a connecting section and a mounting section, wherein the connecting section is adapted to be inserted into a hose/pipe. The mounting section is sequentially formed with a threaded portion and a smooth portion relative to the flange, wherein the threaded portion has a diameter greater than that of the smooth portion. At least two ditches are longitudinally and equally defined in the smooth portion, and each laterally communicates with the hole. A distal end of the smooth portion is formed with an abutment and a round recess centrally defined in the abutment. At least two grooves are respectively equally defined in the abutment, wherein each groove is defined along a corresponding one of the tangents of the round recess and has two opposite ends respectively communicating with the round recess and a corresponding one of the ditches. A cap is longitudinally and airtightly mounted onto the mounting section of the body. The cap includes a cavity centrally and longitudinally defined therein and a funnel-shaped hole defined in a bottom of the cavity. An inner periphery of the cavity is sequentially divided into a threaded portion and a smooth portion, wherein the smooth portion of the cavity has a diameter smaller than that of the threaded portion of the cavity. The smooth portion of the mounting section is airtightly received in the smooth portion of the cavity, the abutment airtightly abuts against the bottom of the cavity and the funnel-shaped hole communicates with the recess when the threaded portion of the cavity is screwed onto the threaded portion of the mounting section.

When misting the water from the hose or pipe, the water sequentially flow through the hole, the at least two ditches and the at least two grooves into the recess, and forms a speedy eddy in the recess for completely misting the water before spraying from the funnel-shaped hole because each groove is defined along a tangent of the recess. As a result, the water, flowing in the misting nozzle in accordance with the present invention, does not need a high pressure and can be completely misted in the recess due to the multiple grooves because they are defined along tangents of the recess.

Further benefits and advantages of the present invention will become apparent after a careful reading of the detailed description with appropriate reference to the accompanying drawings.

DETAILED DESCRIPTION OF THE INVENTION

Figure 1:
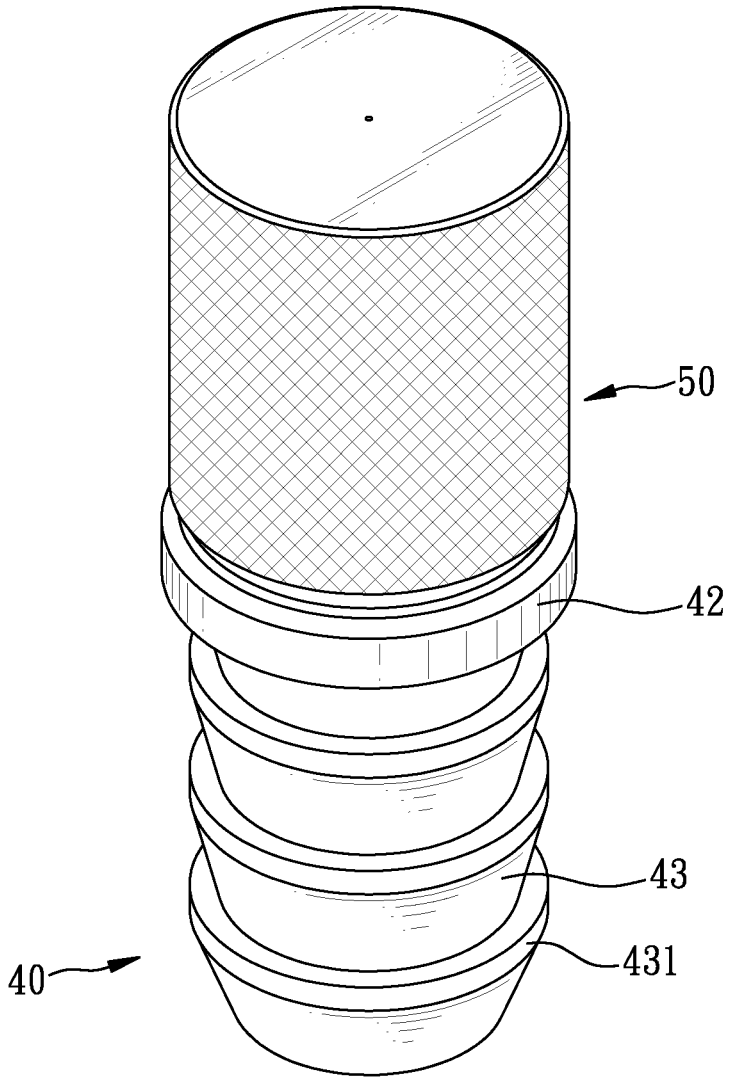
FIG. 1 is a perspective view of a misting nozzle in accordance with the present invention.
Figure 2:
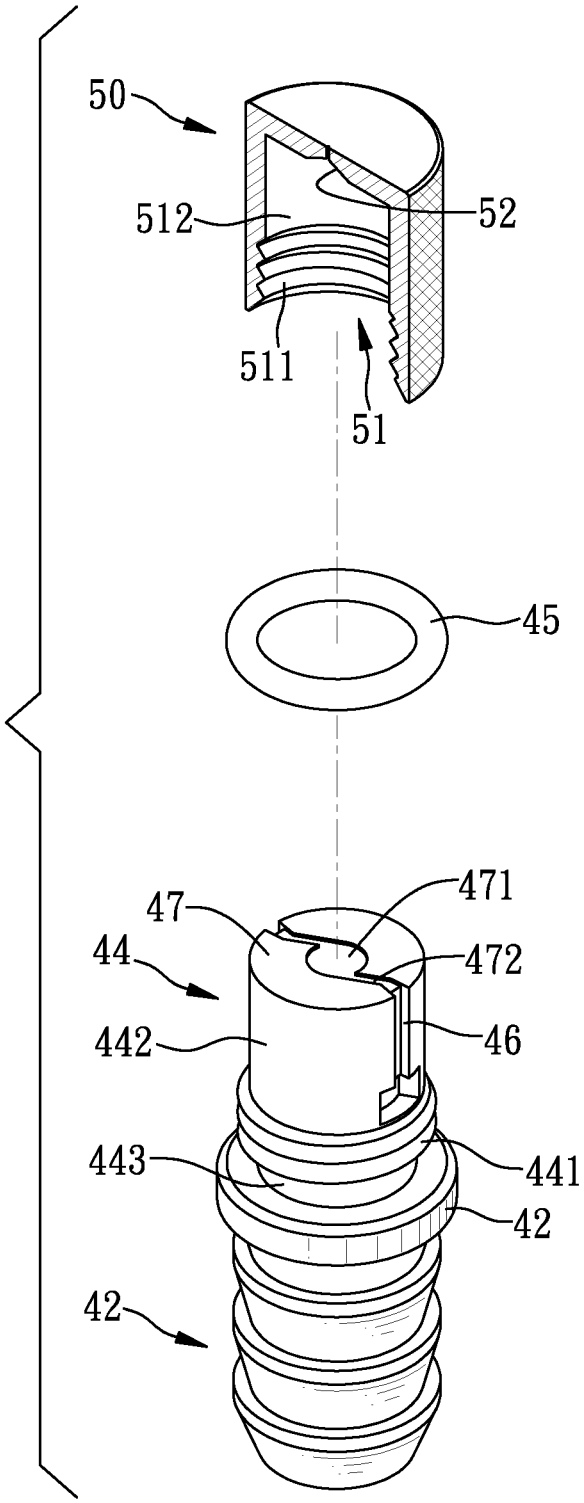
FIG. 2 is an exploded perspective view of the misting nozzle in FIG. 1.
Figure 3:
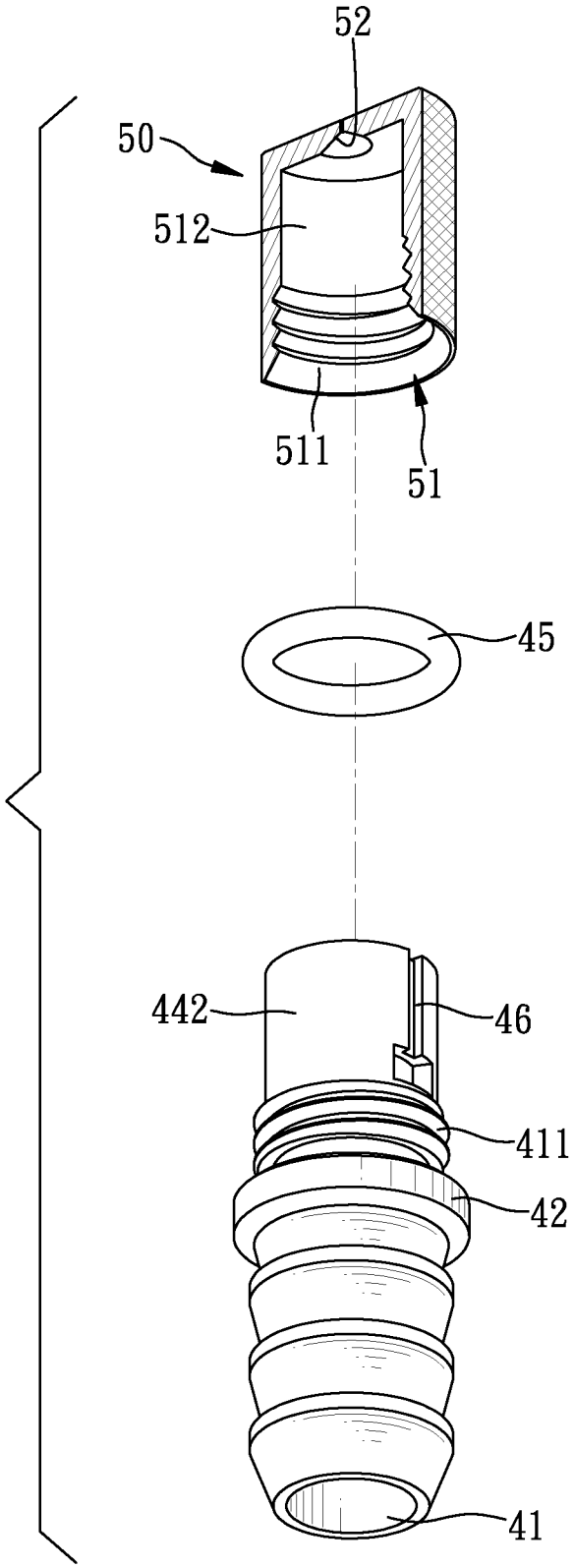
FIG. 3 is another exploded perspective view of the misting nozzle in FIG. 1.

Referring to the drawings and initially to FIGS. 1-3 and 5, a misting nozzle in accordance with the present invention comprises a cylindrical body (40) and a cap (50) longitudinally and airtightly mounted onto the cylindrical body (40).

The cylindrical body (40) includes a hole (41) longitudinally and centrally defined in a first end thereof toward a second end thereof. An flange (42) radially extending from the cylindrical body (40) to divide the cylindrical body (40) into a connecting section (43) and a mounting section (44), wherein the connecting section (43) is provided to be inserted into a hose of a pipe (not shown). In the preferred embodiment of the present invention, the connecting section (43) has a series of annular ratchet structures (431) formed thereon for promoting a friction force between the connecting section (43) and an inner periphery of the hose/pipe. The mounting section (44) is sequentially formed with a threaded portion (441) and a smooth portion (442) relative to the flange (42) of the body (40), wherein the threaded portion (441) has a diameter greater than that of the smooth portion (442). An annular groove (443) defined in the threaded portion (441) near the flange (42) and an O-ring (45) is received in the annular groove (443). At least two ditches (46) are longitudinally and equally defined in the smooth portion (442), and respectively and laterally communicate with the hole (41). The second end of the body (40) is formed with an abutment (47) and a round recess (471) is centrally defined in the abutment (47). At least two grooves (472) respectively equally defined in the abutment (47), wherein each groove (472) is defined along a corresponding one of the tangents of the recess (471) and has two opposite ends respectively communicating with the recess (471) and a corresponding one of the ditches (46). Each groove (472) has a width and a depth respectively smaller than that of each of the ditches (46).

The cap (50) has a cavity (51) centrally and longitudinally defined therein and a funnel-shaped hole (52) is centrally defined in a bottom of the cavity (51). An inner periphery of the cavity (51) is sequentially divided into a threaded portion (511) and a smooth portion (512), wherein the smooth portion (512) has a diameter smaller than that of the threaded portion (511). The smooth portion (442) of the mounting section (44) is airtightly received in the smooth portion (512) of the cavity (51), the abutment (47) airtightly abuts against the bottom of the cavity (51), the funnel-shaped hole (52) communicates with the recess (471) and the cap (50) airtightly abuts against the O-ring (45) when the threaded portion (511) of the cavity (51) is screwed onto the threaded portion (441) of the mounting section (44).

Figure 4:
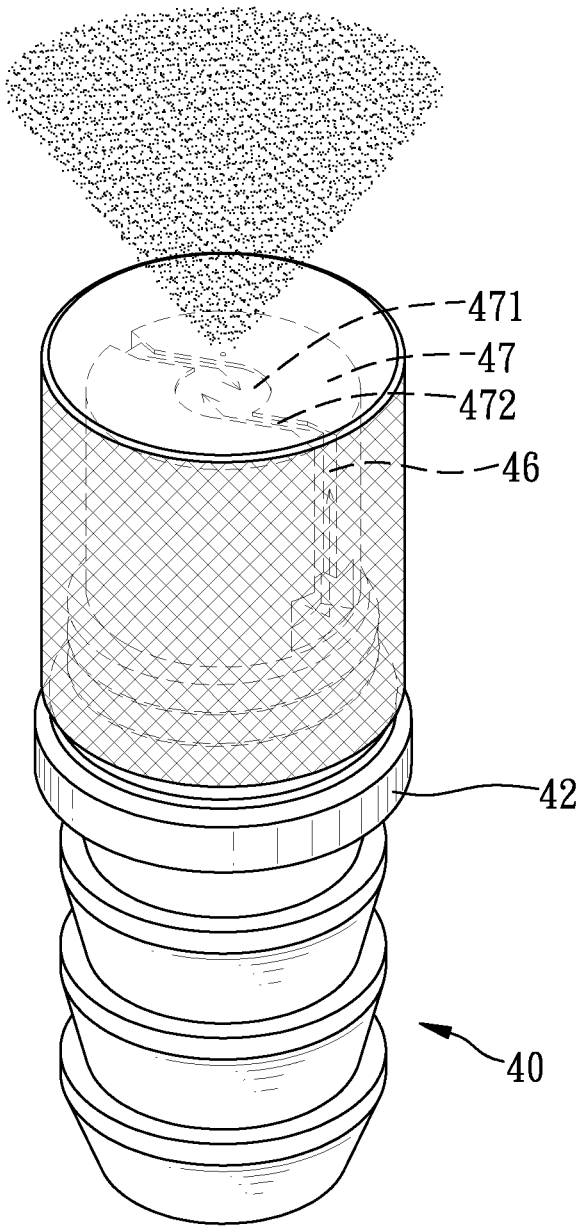
FIG. 4 is a perspective operational view of the misting nozzle in accordance with the present invention.
Figure 5:
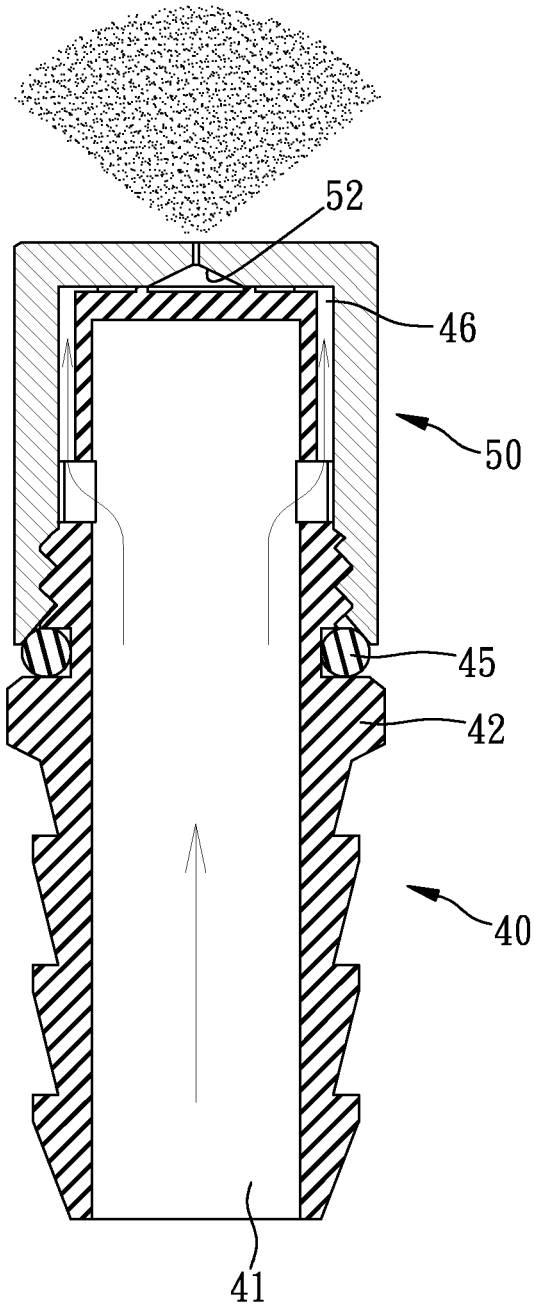
FIG. 5 is a cross-sectional operational view of the misting nozzle in accordance with the present invention.
Figure 6:
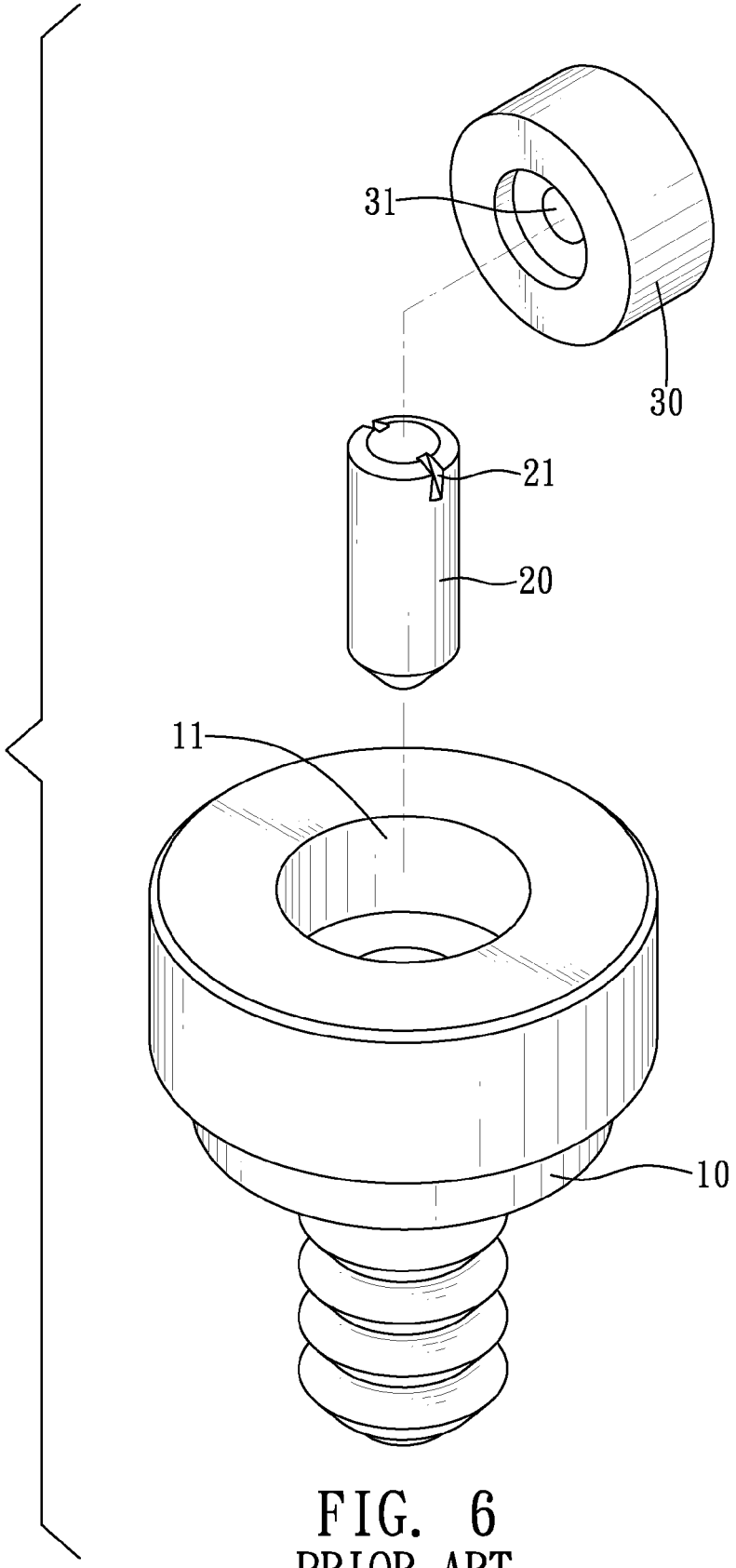
FIG. 6 PRIOR ART
FIG. 6 is an exploded perspective view of a conventional misting nozzle in accordance with the prior art.
Figure 7:
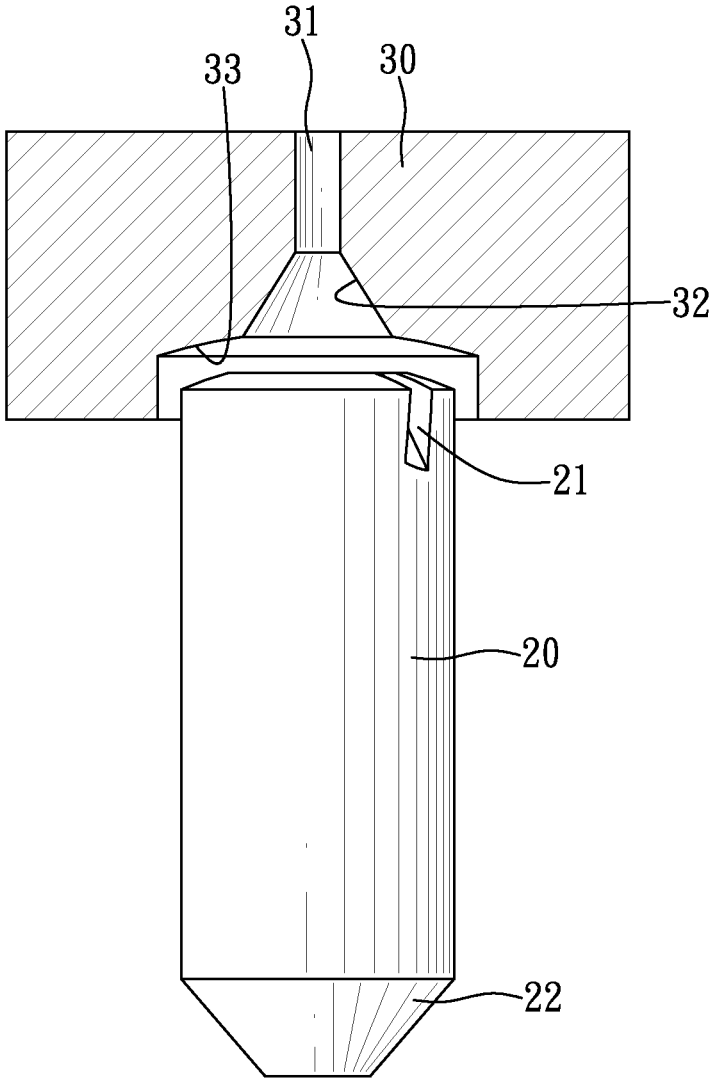
FIG. 7 PRIOR ART
FIG. 7 is a partially cross-sectional view of the conventional misting nozzle in accordance with the prior art.
Figure 8:
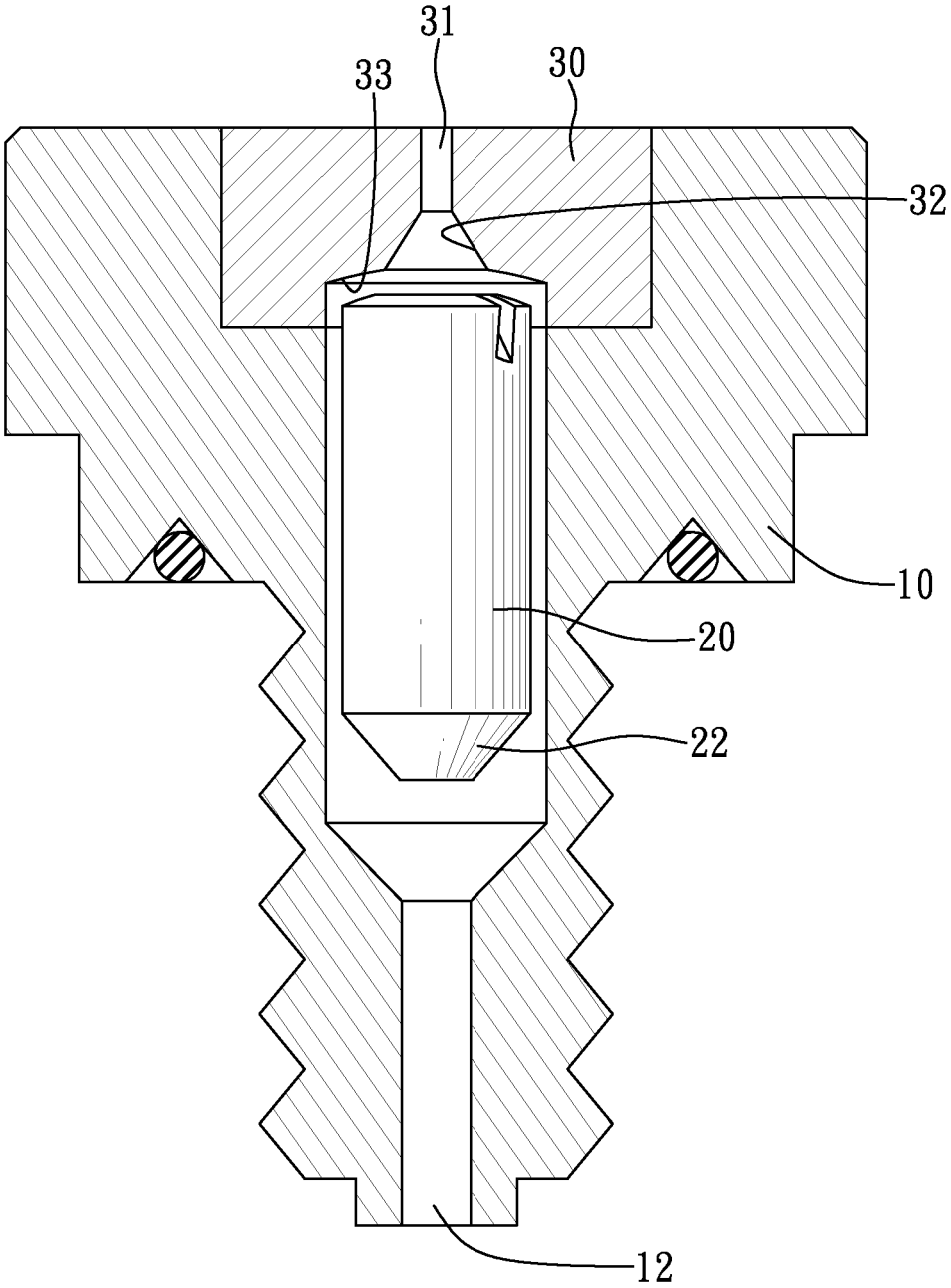
FIG. 8 PRIOR ART
FIG. 8 is a cross-sectional view of the conventional misting nozzle in accordance with the prior art.
Figure 9:
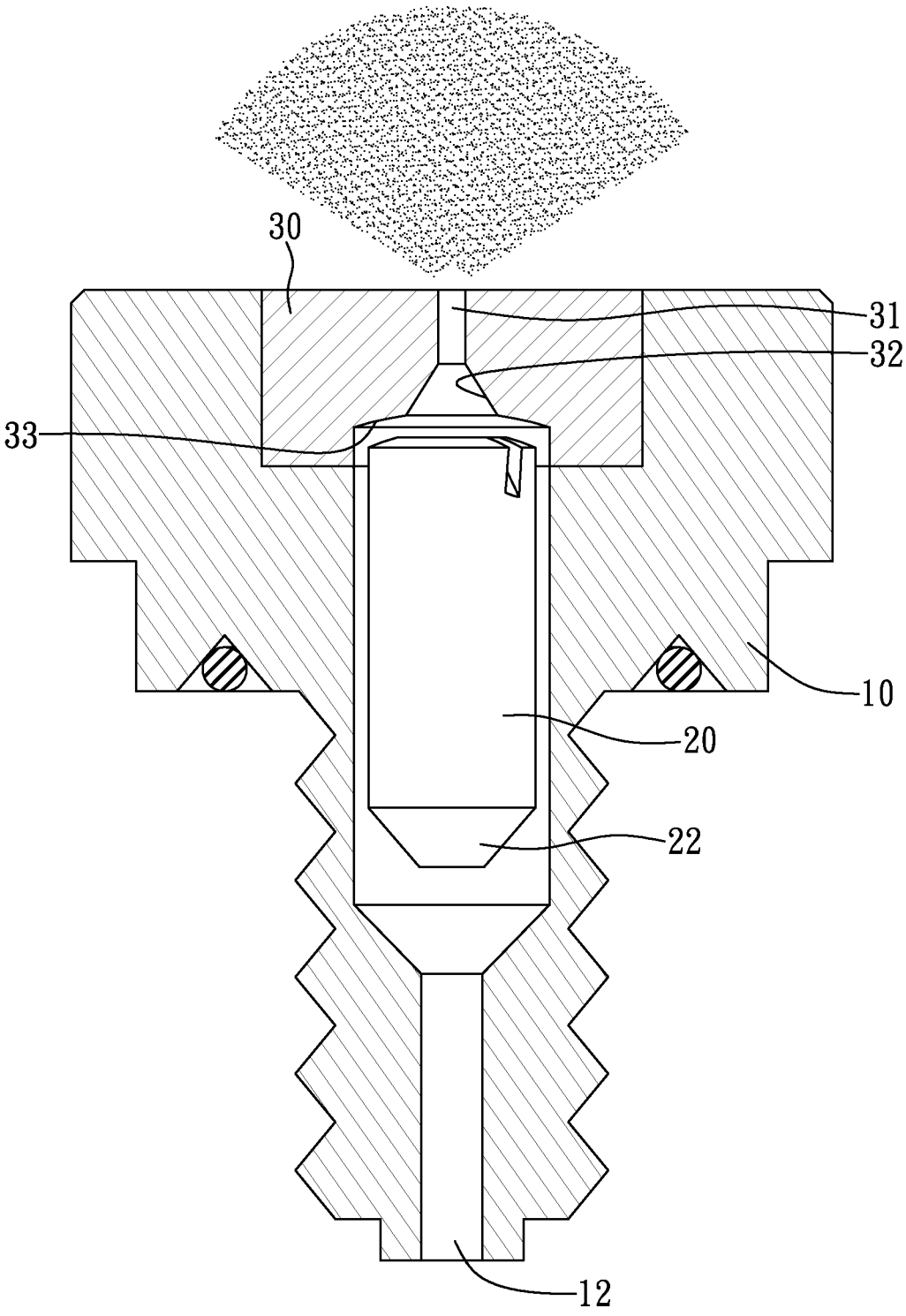
FIG. 9 PRIOR ART
FIG. 9 is an operational view in cross-section of the conventional misting nozzle in accordance with the prior art.

With reference to FIGS. 4 and 5, when misting the water from the hose or pipe, the water sequentially flow through the hole (41), the at least two ditches (46) and the at least two grooves (472) into the recess (471), and forms a speedy eddy in the recess (471) for completely misting the water before spraying from the funnel-shaped hole (52) because each groove (472) is defined along a tangent of the recess (471). As a result, the water, flowing in the misting nozzle in accordance with the present invention, does not need a high pressure and can be completely misted in the recess (471) due to the multiple grooves (472) because they are defined along tangents of the recess (471).

Although the invention has been explained in relation to its preferred embodiment, it is to be understood that many other possible modifications and variations can be made without departing from the spirit and scope of the invention as hereinafter claimed.

What is claimed is:

1. A misting nozzle comprising:

a body having a hole centrally and longitudinally defined therein and a flange radially extending therefrom to divide the body into a connecting section and a mounting section, wherein the connecting section is adapted to be inserted into a hose or pipe, the mounting section sequentially formed with a threaded portion and a smooth portion relative to the flange, wherein the threaded portion has a diameter greater than that of the smooth portion, at least two channels longitudinally and equally defined in the smooth portion, and each laterally communicating with the hole, a distal end of the smooth portion formed with an abutment and a round recess centrally defined in the abutment, at least two grooves respectively equally defined in the abutment, wherein each groove is defined along a corresponding one of tangents of the round recess and has two opposite ends respectively communicating with the round recess and a corresponding one of the channels; and a cap longitudinally and airtightly mounted onto the mounting section of the body, the cap including a cavity centrally and longitudinally defined therein and a funnel-shaped hole defined in a bottom of the cavity, an inner periphery of the cavity sequentially divided into a threaded portion and a smooth portion, wherein the smooth portion of the cavity has a diameter smaller than that of the threaded portion of the cavity, the smooth portion of the mounting section is airtightly received in the smooth portion of the cavity, the abutment airtightly abuts against the bottom of the cavity and the funnel-shaped hole communicates with the recess when the threaded portion of the cavity is screwed onto the threaded portion of the mounting section.

2. The misting nozzle as claimed in claim 1, wherein the connecting section of the body has a series of annular ratchet structures formed thereon for promoting a friction force between the connecting section and an inner periphery of the hose/pipe.

3. The misting nozzle as claimed in claim 1, wherein an annular groove is defined in the threaded portion near the flange and an O-ring is received in the annular groove.

4. The misting nozzle as claimed in claim 2, wherein an annular groove is defined in the threaded portion near the flange and an O-ring is received in the annular groove.

5. The misting nozzle as claimed in claim 3, wherein the cap airtightly abuts against the O-ring when screwed onto the threaded portion of the mounting section.

6. The misting nozzle as claimed in claim 4, wherein the cap airtightly abuts against the O-ring when screwed onto the threaded portion of the mounting section.

* * * * *